US009784127B2

(12) United States Patent
Kuhlbach et al.

(10) Patent No.: US 9,784,127 B2
(45) Date of Patent: Oct. 10, 2017

(54) INTERNAL COMBUSTION ENGINE WITH COOLED TURBINE

(71) Applicant: FORD GLOBAL TECHNOLOGIES, LLC, Dearborn, MI (US)

(72) Inventors: Kai Sebastian Kuhlbach, Bergisch Gladbach NRW (DE); Clemens Maria Verpoort, Monheim am Rhein NRW (DE); Jan Mehring, Cologne NRW (DE); Carsten Weber, Leverkusen NRW (DE); Stefan Quiring, Leverkusen NRW (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/605,567

(22) Filed: Jan. 26, 2015

(65) Prior Publication Data

US 2015/0211383 A1 Jul. 30, 2015

(30) Foreign Application Priority Data

Jan. 27, 2014 (DE) ..... 10 2014 201 411

(51) Int. Cl.
*F02B 29/04* (2006.01)
*F01D 25/14* (2006.01)

(52) U.S. Cl.
CPC ..... *F01D 25/145* (2013.01); *F01D 25/14* (2013.01); *F05D 2220/40* (2013.01); *F05D 2230/21* (2013.01); *F05D 2300/5024* (2013.01)

(58) Field of Classification Search
CPC ..... F01D 25/145; F01D 25/14; F01D 25/12; F05D 2300/5024; F05D 2220/40; F05D 2230/21; F02B 39/005
(Continued)

(56) References Cited

U.S. PATENT DOCUMENTS 3,750,403 A * 8/1973 Deutschmann ..... F01N 3/046 60/272
3,877,126 A * 4/1975 Deutschmann ..... B22D 19/00 123/669
(Continued)

FOREIGN PATENT DOCUMENTS

DE 102007017973 A1 1/2008
DE 102008011257 A1 9/2009
(Continued)

OTHER PUBLICATIONS

German Examination Report for corresponding Application No. 10 2014 201 411.5, dated Nov. 20, 2014, 6 pages.

*Primary Examiner* — Jason Shanske
*Assistant Examiner* — Jason T Newton
(74) *Attorney, Agent, or Firm* — Brooks Kushman P.C.; Greg Brown

(57) ABSTRACT

An internal combustion engine has a cylinder head with at least one cylinder and a cooled turbine. Each cylinder has at least one outlet opening adjoined by an exhaust line for discharging exhaust gases from the cylinder. The exhaust line issues into an inlet region transitioning into an exhaust gas-conducting flow duct of the turbine. The turbine has at least one rotor mounted on a rotatable shaft in a turbine housing. The turbine has at least one coolant duct which is integrated in the housing and which is delimited and formed by at least one wall of the housing to form a cooling arrangement. The at least one wall of the turbine housing that delimits the at least one coolant duct is provided, at least in regions, with a thermal insulation.

20 Claims, 2 Drawing Sheets

(58) Field of Classification Search
USPC ..... 60/599, 605.3; 417/406; 415/200, 415/205–206
See application file for complete search history.

(56) References Cited

U.S. PATENT DOCUMENTS 3,919,755 A * 11/1975 Kaneko ..... B22D 19/00 123/193.5
4,277,539 A * 7/1981 Keller ..... B22D 19/00 106/38.27
4,715,178 A * 12/1987 Tsukuda ..... F02B 77/02 123/193.5
5,020,319 A * 6/1991 Matsuura ..... F01N 3/046 123/193.5
5,404,721 A * 4/1995 Hartsock ..... F01N 13/102 60/300
6,001,436 A * 12/1999 Strasser ..... C04B 35/80 428/293.4
6,874,998 B2 * 4/2005 Roby ..... F01D 25/125 415/111
2002/0023436 A1 2/2002 Akiwa et al.
2007/0113552 A1 * 5/2007 Fremerey ..... F01D 25/145 60/605.1
2010/0284824 A1 * 11/2010 Hippen ..... F01M 11/02 417/44.1
2011/0154818 A1 6/2011 Takahata
2011/0252775 A1 * 10/2011 Joergl ..... F01D 25/145 60/321
2012/0055424 A1 * 3/2012 Kuhlbach ..... F02B 33/44 123/41.31

FOREIGN PATENT DOCUMENTS

EP 1384857 A2 1/2004
EP 1591639 A1 11/2005
JP 10183233 A * 7/1998 ..... C21D 1/00
WO 2010039590 A2 4/2010

* cited by examiner

INTERNAL COMBUSTION ENGINE WITH COOLED TURBINE

CROSS-REFERENCE TO RELATED APPLICATIONS

This application claims foreign priority benefits under 35 U.S.C. §119(a)-(d) to DE 10 2014 201 411.5 filed Jan. 27, 2014, which is hereby incorporated by reference in its entirety

TECHNICAL FIELD

Various embodiments of the disclosure relate to an internal combustion engine having at least one cylinder head and a cooled turbine.

BACKGROUND

Internal combustion engines have a cylinder block and at least one cylinder head which are connected to one another at their assembly end sides so as to form at least one cylinder, that is to say a combustion chamber.

To hold the pistons or the cylinder liners, the cylinder block has a corresponding number of cylinder bores. The pistons are guided in the cylinder liners in an axially movable fashion and form, together with the cylinder liners and the cylinder head, the combustion chambers of the internal combustion engine.

The cylinder head conventionally serves to hold the valve drive. To control the charge exchange, an internal combustion engine requires control elements and actuating devices for actuating the control elements. During the charge exchange, the combustion gases are discharged via the outlet openings and the combustion chamber is charged, that is to say the fresh mixture or the charge air is inducted, via the inlet openings. To control the charge exchange, in four-stroke engines, use is made almost exclusively of lifting valves as control elements, which lifting valves perform an oscillating lifting movement during the operation of the internal combustion engine and which lifting valves open and close the inlet and outlet openings in this way. The valve actuating mechanism required for the movement of the valves, including the valves themselves, is referred to as the valve drive.

According to the prior art, the inlet ducts which lead to the inlet openings, and the outlet ducts, that is to say the exhaust lines which adjoin the outlet openings, are at least partially integrated in the cylinder head. The exhaust lines of the outlet openings of a single cylinder are in this case generally merged—within the cylinder head—to form a component exhaust line associated with the cylinder, before said component exhaust lines are merged—commonly to form a single overall exhaust line. The merging of exhaust lines to form an overall exhaust line is referred to generally, and within the context of the present invention, as an exhaust manifold.

Downstream of the at least one manifold, the exhaust gases may then supplied to a turbine, for example the turbine of an exhaust-gas turbocharger, and may be conducted through one or more exhaust-gas aftertreatment systems as appropriate.

The production costs for the turbine may be comparatively high because the—often nickel-containing—material used for the thermally highly loaded turbine housing is expensive, in particular in relation to the material preferably used for the cylinder head, for example aluminum. Not only the material costs themselves, but also the costs for the machining of said materials used for the turbine housing are relatively high.

From that which has been stated above, it follows that, with regard to costs, it would be highly advantageous if a turbine could be provided which could be produced from a less expensive material, for example aluminum or cast iron.

The use of aluminum would also be advantageous with regard to the weight of the turbine. This is true in particular when it is taken into consideration that an arrangement of the turbine close to the engine leads to a relatively large-dimensioned, voluminous housing. This is because the connection of the turbine and cylinder head by means of a flange and screws requires a large turbine inlet region on account of the restricted spatial conditions, also because adequate space must be provided for the assembly tools. The voluminous housing is associated with a correspondingly high weight. The weight advantage of aluminum over a highly loadable material is particularly pronounced in the case of a turbine arranged close to the engine on account of the comparatively high material usage.

To be able to use cheaper materials for producing the turbine, the turbine according to the prior art is provided with a cooling arrangement, for example with a liquid-type cooling arrangement, which significantly reduces the thermal loading of the turbine and of the turbine housing by the hot exhaust gases and therefore permits the use of thermally less highly loadable materials.

In general, the turbine housing is provided with a coolant jacket in order to form a cooling arrangement. The prior art discloses both concepts in which the housing is a cast part and the coolant jacket is formed, during the casting process, as an integral constituent part of a monolithic housing, and concepts in which the housing is of modular construction, wherein during assembly a cavity is formed which serves as a coolant jacket.

A turbine designed according to the latter concept is described for example in the German laid-open specification DE 10 2008 011 257 A1. A liquid-type cooling arrangement of the turbine is formed by virtue of the actual turbine housing being provided with a casing, such that a cavity into which coolant can be introduced is formed between the housing and the at least one casing element arranged spaced apart therefrom. The housing which is expanded to include the casing arrangement then encompasses the coolant jacket. EP 1 384 857 A2 likewise discloses a turbine whose housing is equipped with a coolant jacket. DE 10 2007 017 973 A1 describes a construction kit for forming a vapor-cooled turbine casing.

On account of the high specific heat capacity of a liquid, in particular of water which is conventionally used, large amounts of heat can be extracted from the housing by means of liquid-type cooling. The heat is dissipated to the coolant in the interior of the housing and is discharged with the coolant. The heat which is dissipated to the coolant is extracted from the coolant again in a heat exchanger.

It is basically possible for the liquid-type cooling arrangement of the turbine to be equipped with a separate heat exchanger or else—in the case of a liquid-cooled internal combustion engine—for the heat exchanger of the engine cooling arrangement, that is to say the heat exchanger of a different liquid-type cooling arrangement, to be used for this purpose. The latter merely requires corresponding connections between the two circuits.

It must however be taken into consideration in this context that the amount of heat to be absorbed by the coolant in the turbine may amount to 40 kW or more if materials that can be subjected to only low thermal loading, such as aluminum, are used to produce the housing. It has proven to be problematic for such a large amount of heat to be extracted from the coolant, and discharged to the environment by means of an air flow, in the heat exchanger.

Modern motor vehicle drives are duly equipped with high-powered fan motors in order to provide, at the heat exchangers, the air mass flow required for an adequately high heat transfer. However, a further parameter which is significant for the heat transfer, specifically the surface area provided for the heat transfer, cannot be made arbitrarily large or enlarged arbitrarily because the space availability in the front-end region of the vehicle, where the various heat exchangers are generally arranged, is limited.

Aside from the heat exchanger for engine cooling, modern motor vehicles often have further heat exchangers, in particular cooling devices.

A charge-air cooler is often arranged on the intake side of a supercharged internal combustion engine in order to contribute to improved charging of the cylinders. The heat dissipation via the oil sump by heat conduction and natural convection is often no longer sufficient to adhere to a maximum admissible oil temperature, such that in individual situations an oil cooler is provided. Furthermore, modern internal combustion engines are increasingly being equipped with exhaust-gas recirculation (EGR). Exhaust-gas recirculation is a measure for counteracting the formation of nitrogen oxides. To obtain a considerable reduction in nitrogen oxide emissions, high exhaust-gas recirculation rates are required, which demand cooling of the exhaust gas to be recirculated, that is to say a compression of the exhaust gas by cooling. Further coolers may be provided, for example in order to cool the transmission oil in the case of automatic transmissions and/or to cool hydraulic fluids, in particular hydraulic oil, which is used within hydraulically actuable adjusting devices and/or for steering assistance. The air-conditioning condenser of an air-conditioning system is likewise a heat exchanger which must dissipate heat to the environment during operation, that is to say which requires an adequately large air flow and must therefore be arranged in the front-end region.

On account of the extremely limited spatial conditions in the front-end region and the multiplicity of heat exchangers, the individual heat exchangers may not be able to be dimensioned as required.

In fact, it may not be possible in the front-end region to arrange an adequately large heat exchanger for liquid-type cooling of the turbine in order to be able to also dissipate the large amounts of heat that arise when using materials that can be subjected to only low thermal loading.

In the structural design of a cooled turbine, a compromise between cooling capacity and material is therefore necessary.

To be able to use cheaper materials for the turbine, it is also possible according to the prior art for the turbine to be equipped, on the exhaust-gas side, with insulation. Such a concept is disclosed in the international application WO 2010/039590 A1.

SUMMARY

Against the background of that stated above, it is the object of the present invention to provide an internal combustion engine which is optimized with regard to the turbine.

According to at least one embodiment, said object is achieved by means of an internal combustion engine comprising at least one cylinder head with cooled turbine. The at least one cylinder head has at least one cylinder, and each cylinder has at least one outlet opening for discharging the exhaust gases from the cylinder and each outlet opening is adjoined by an exhaust line. The at least one exhaust line of at least one cylinder issues into an inlet region, which transitions into an exhaust gas-conducting flow duct, of the turbine. The turbine, which comprises at least one rotor which is mounted on a rotatable shaft in a turbine housing, has, to form a cooling arrangement, at least one coolant duct which is integrated in the housing and which is delimited and formed by at least one wall. The at least one wall that delimits the at least one coolant duct is provided, at least in regions, with thermal insulation.

According to the disclosure, the at least one coolant duct integrated in the turbine housing may be equipped with thermal insulation, that is to say the wall that delimits said coolant duct is—at least regionally—provided, that is to say coated, lined or similar, with thermal insulation. In the context of the present invention, thermal insulation is distinguished from the housing material that is used very generally by the fact that the thermal insulation exhibits lower thermal conductivity than said material.

In the present case, it is not sought to dissipate the greatest possible amount of heat from the housing. By contrast to this conventional aim, it is provided according to the invention that, by the introduction of thermal insulation, it is made more difficult for the cooling arrangement to extract heat from the housing and cool said housing. The cooling power is intentionally restricted and reduced by the introduction of insulation. The thermal permeability of the heat-transmitting surface, that is to say of the wall, is reduced, wherein it is the case according to the invention, too, that heat is introduced from the housing into the coolant, this however being so to a lesser extent than according to the prior art.

By means of said measure, the maximum amount of heat to be dissipated is advantageously reduced or limited. The problem of having to dissipate very large amounts of heat absorbed by the coolant in the turbine is thus eliminated.

Corresponding to the moderate cooling power, a suitable material, specifically cast iron or cast steel or the like, may be selected for the production of the turbine according to the invention.

Firstly, the concept according to the invention makes it possible to dispense with thermally highly loadable, in particular nickel-containing materials for producing the turbine housing, since the turbine is also provided, according to the invention, with a cooling arrangement. Secondly, the cooling power is not such that materials that can be subjected to only low thermal loading, such as aluminum, can be used.

The approach according to the invention thus makes it possible to dispense with the use of expensive materials, without it being necessary for excessively large amounts of heat to be dissipated in conjunction with the cooling of the turbine.

The object on which the invention is based is thereby achieved, that is to say an internal combustion engine is provided which is optimized with regard to the turbine.

The main distinguishing feature of the approach according to the invention in relation to concepts according to the prior art, in which the housing is protected against excessive introduction of heat at the exhaust-gas side by insulation, can be seen in the fact that, according to the invention, the introduction of heat into the housing or into the housing material is not hindered or restricted by insulation. Furthermore, embodiments can be realized in which the coolant-side surface is of considerably smaller dimensions than the exhaust gas-side surface, thus reducing the extent over which insulation has to be introduced.

The turbine according to the invention is suitable in particular for supercharged internal combustion engines which, owing to the relatively high exhaust-gas temperatures, are subject to particularly high thermal loading. Cooling of the turbine of the exhaust-gas turbocharger is consequently advantageous.

Embodiments are therefore also advantageous in which the turbine is a constituent part of an exhaust-gas turbocharger.

Supercharging serves primarily to increase the power of the internal combustion engine. Here, the air required for the combustion process is compressed, as a result of which a greater air mass can be supplied to each cylinder per working cycle. In this way, the fuel mass and therefore the mean pressure can be increased.

Supercharging is a suitable means for increasing the power of an internal combustion engine while maintaining an unchanged swept volume, or for reducing the swept volume while maintaining the same power. In any case, supercharging leads to an increase in volumetric power output and an improved power-to-weight ratio. For the same vehicle boundary conditions, it is thus possible to shift the load collective toward higher loads, at which the specific fuel consumption is lower. Supercharging consequently assists in the constant efforts in the development of internal combustion engines to minimize fuel consumption, that is to say to improve efficiency.

The advantage of an exhaust-gas turbocharger in relation to a mechanical charger is that no mechanical connection for transmitting power exists or is required between the charger and the internal combustion engine. While a mechanical charger draws the energy required for driving it directly from the internal combustion engine, the exhaust-gas turbocharger utilizes the exhaust-gas energy of the hot exhaust gases.

If the cylinder head has one cylinder and said cylinder has only one outlet opening, the single exhaust line associated with the cylinder forms the exhaust-gas discharge system, that is to say the overall exhaust line, or the manifold, which issues into the turbine. This is also a cylinder head according to the invention.

Embodiments are advantageous in which the cylinder head has at least two cylinders.

If the cylinder head has two cylinders and only the exhaust lines of one cylinder form an overall exhaust line that issues into the turbine, this is likewise a cylinder head according to the invention.

If the cylinder head has three or more cylinders, and if only the exhaust lines of two cylinders merge to form an overall exhaust line, this is likewise a cylinder head according to the invention.

Embodiments of the cylinder head in which the cylinder head has, for example, four cylinders in an in-line arrangement and the exhaust lines of the outer cylinders and the exhaust lines of the inner cylinders merge to form in each case one overall exhaust line, are likewise cylinder heads according to the invention.

In the case of three or more cylinders, embodiments are therefore also advantageous in which at least three cylinders are configured in such a way as to form two groups with in each case at least one cylinder, and the exhaust lines of the cylinders of each cylinder group merge to form a respective overall exhaust line, thus forming an exhaust manifold.

Said embodiment is suitable in particular for the use of a twin-channel turbine. A twin-channel turbine has an inlet region with two inlet ducts, that is to say in effect two inlet regions, with the two overall exhaust lines being connected to the twin-channel turbine in such a way that in each case one overall exhaust line opens out into one inlet duct. The merging of the two exhaust-gas flows which are conducted in the overall exhaust lines takes place if appropriate downstream of the turbine. If the exhaust lines are grouped in such a way that the high pressures, in particular the pre-outlet shocks, can be maintained, a two-channel turbine is particularly suitable for pulse supercharging, by means of which high turbine pressure ratios can be obtained even at low rotational speeds.

The grouping of the cylinders or exhaust lines however also offers advantages for the use of a plurality of turbines or exhaust-gas turbochargers, with in each case one overall exhaust line being connected to one turbine.

Embodiments are however also advantageous in which the exhaust lines of all the cylinders of the cylinder head merge to form a single, that is to say common, overall exhaust line.

Further advantageous embodiments of the internal combustion engine are discussed below.

Embodiments of the internal combustion engine are advantageous in which more than 50% of the at least one wall is provided with thermal insulation.

Embodiments of the internal combustion engine are advantageous in which more than 70% of the at least one wall is provided with thermal insulation.

Embodiments of the internal combustion engine are advantageous in which more than 80% of the at least one wall is provided with thermal insulation.

Embodiments of the internal combustion engine are advantageous in which the entirety of the at least one wall is provided with thermal insulation.

Embodiments of the internal combustion engine are advantageous in which the thermal insulation comprises enamel.

Embodiments of the internal combustion engine are also advantageous in which the thermal insulation comprises ceramic.

Embodiments of the internal combustion engine are advantageous in which the thermal insulation is at least also formed by way of surface treatment. To form the thermal insulation, it is also possible for material, for example enamel or ceramic or the like, to be initially introduced and subsequently subjected to surface treatment. If appropriate, the thermal insulation may be formed exclusively by surface treatment.

Embodiments of the internal combustion engine are advantageous in which the turbine is a radial turbine.

If the turbine is designed as a radial turbine, then the flow approaching the rotor blades runs substantially radially. Here, "substantially radially" means that the speed component in the radial direction is greater than the axial speed component. The speed vector of the flow intersects the shaft or axle of the turbine, specifically at right angles if the approaching flow runs exactly radially. In this respect, the turbine may also be of mixed-flow design, as long as the speed component in the radial direction is larger than the speed component in the axial direction.

To make it possible for the rotor blades to be approached by flow radially, the inlet region for the supply of the exhaust gas is often designed as an encircling spiral or worm housing, such that the inflow of exhaust gas to the turbine runs substantially radially.

Embodiments of the internal combustion engine are therefore also advantageous in which the at least one coolant duct, at least in sections, extends in spiral form around the shaft in the housing.

In this connection, embodiments of the internal combustion engine are also advantageous in particular in which the at least one coolant duct extends circumferentially around and at a distance from the flow duct over an angle $\alpha$, where $\alpha \leq 45°$.

Embodiments of the internal combustion engine are likewise advantageous in which the following applies: $\alpha \leq 30°$ or $\alpha \leq 20°$ or $\alpha \leq 15°$.

The smaller the angle range in which the coolant duct extends over the flow duct in the circumferential direction, the less voluminous the housing needs to be, that is to say the less material needs to be used, the material usage being significantly co-determined by the size of the coolant duct to be integrated. Consequently, the weight of the housing also decreases or increases with the size of the coolant duct.

With regard to the latter embodiments, reference is made to the German patent application with the file reference DE 10 2010 037 378.8.

Embodiments of the internal combustion engine are advantageous in which the turbine has a single coolant duct, which is integrated in the housing, in order to form a cooling arrangement.

Embodiments of the internal combustion engine are advantageous in which the turbine housing is a cast part into which the thermal insulation is introduced during the course of post-processing. Post-processing is considered in particular to mean coating and surface treatment.

Embodiments of the internal combustion engine are advantageous in which each cylinder has two outlet openings for discharging the exhaust gases out of the cylinder.

It is the object of the valve drive to open and close the inlet and outlet openings of the combustion chamber at the correct times, with a fast opening of the greatest possible flow cross sections being sought in order to keep the throttling losses in the inflowing and outflowing gas flows low and in order to ensure the best possible charging of the combustion chamber with fresh mixture, and an effective, that is to say complete discharge of the exhaust gases. It is therefore advantageous for the cylinders to be provided with two or more outlet openings.

Embodiments of the internal combustion engine are advantageous in which the exhaust lines merge to form at least one overall exhaust line, thus forming at least one exhaust manifold, wherein said at least one overall exhaust line issues into the inlet region of the turbine.

In particular, embodiments of the internal combustion engine are advantageous in which the exhaust lines of the cylinders merge to form at least one overall exhaust line within the cylinder head, thus forming at least one integrated exhaust manifold, wherein said at least one overall exhaust line issues into the inlet region of the turbine.

It must be taken into consideration that it may be fundamentally sought to arrange the turbine, in particular the turbine of an exhaust-gas turbocharger, as close as possible to the outlet of the cylinders in order thereby to be able to optimally utilize the exhaust-gas enthalpy of the hot exhaust gases, which is determined significantly by the exhaust-gas pressure and the exhaust-gas temperature, and to ensure a fast response behavior of the turbine or of the turbocharger. Furthermore, the path of the hot exhaust gases to the different exhaust-gas aftertreatment systems may also be as short as possible such that the exhaust gases are given little time to cool down and the exhaust-gas aftertreatment systems reach their operating temperature or light-off temperature as quickly as possible, in particular after a cold start of the internal combustion engine.

It is therefore sought to minimize the thermal inertia of the part of the exhaust line between the outlet opening at the cylinder and the turbine or between the outlet opening at the cylinder and the exhaust-gas aftertreatment system, which can be achieved by reducing the mass and the length of said part.

To achieve this aim, the exhaust lines are merged within the cylinder head, such that at least one integrated exhaust manifold is formed.

The length of the exhaust lines is reduced in this way. Firstly, the size of the line volume, that is to say the exhaust-gas volume of the exhaust lines upstream of the turbine, is reduced, such that the response behavior of the turbine is improved. Secondly, the shortened exhaust lines also lead to a reduced thermal inertia of the exhaust system upstream of the turbine, such that the temperature of the exhaust gases at the turbine inlet is increased, as a result of which the enthalpy of the exhaust gases at the inlet of the turbine is also higher.

Furthermore, the merging of the exhaust lines within the cylinder head permits dense packaging of the drive unit.

A cylinder head designed in this way is however thermally more highly loaded than a conventional cylinder head equipped with an external manifold, and therefore places higher demands on the cooling arrangement.

The heat released during the combustion by the exothermic, chemical conversion of the fuel is dissipated partially to the cylinder head and cylinder block via the walls which delimit the combustion chamber and partially to the adjacent components and the environment via the exhaust-gas flow. To keep the thermal loading of the cylinder head within limits, a part of the heat flow introduced into the cylinder head must be extracted from the cylinder head again.

On account of the high heat capacity of a liquid, it is possible for significantly higher heat quantities to be dissipated with a liquid-type cooling arrangement than with an air-type cooling arrangement, for which reason cylinder heads of the type in question are advantageously provided with a liquid-type cooling arrangement.

Liquid-type cooling necessitates that the cylinder head be equipped with at least one coolant jacket, that is to say necessitates the provision of coolant ducts which conduct the coolant through the cylinder head. The heat is released to the coolant in the interior of the cylinder head, said coolant being conveyed, so as to circulate in the coolant jacket, by means of a pump arranged in the cooling circuit. The heat dissipated to the coolant is discharged from the interior of the cylinder head in this way, and is extracted from the coolant again in a heat exchanger.

A liquid-type cooling arrangement has proven to be advantageous in particular in the case of supercharged engines because the thermal loading of supercharged engines is considerably higher than that of conventional internal combustion engines.

From that which has been stated above, it follows that embodiments of the cylinder head are advantageous in which the cylinder head is provided with at least one coolant jacket, which is integrated in the cylinder head, in order to form a liquid-type cooling arrangement.

Embodiments of the internal combustion engine are advantageous in which the at least one coolant jacket that is integrated in the cylinder head is connected to the at least one coolant duct of the turbine.

If the at least one coolant jacket which is integrated in the cylinder head is connected to the at least one coolant duct of the turbine, the other components and assemblies required to form a cooling circuit need be provided only singularly, as these may be used both for the cooling circuit of the turbine and also for that of the cylinder head, which leads to synergies and considerable cost savings, but also entails a weight saving. For example, it is preferable for only one pump for conveying the coolant, and one container for storing the coolant, to be provided. The heat dissipated to the coolant in the cylinder head and in the turbine housing can be extracted from the coolant in a common heat exchanger.

Furthermore, the coolant duct of the turbine may be supplied with coolant via the cylinder head, such that no further coolant supply and discharge openings need be provided on the turbine housing, and further coolant lines can also be dispensed with.

Embodiments of the internal combustion engine are advantageous in which the at least one cylinder head can be connected, at an assembly end side, to a cylinder block. The at least one coolant jacket integrated in the cylinder head has a lower coolant jacket, which is arranged between the exhaust lines and the assembly end side of the cylinder head, and an upper coolant jacket, which is arranged on that side of the exhaust lines which is situated opposite the lower coolant jacket. The upper coolant jacket and the lower coolant jacket are preferably connected to one another.

Here, embodiments of the internal combustion engine are advantageous in which the lower coolant jacket and/or the upper coolant jacket are connected to the coolant jacket of the turbine.

The cooling may additionally and advantageously be improved by virtue of a pressure gradient being generated between the upper and lower coolant jackets, that leads to increased heat transfer as a result of convection.

Such a pressure gradient also offers advantages if the lower coolant jacket and the upper coolant jacket are connected to the coolant duct of the turbine or are connected to one another via the coolant jacket of the turbine. The pressure gradient then serves as a driving force for conveying the coolant through the coolant duct of the turbine.

Embodiments of the internal combustion engine are advantageous in which the turbine and the cylinder head are separate components which are connected to one another in a non-positively locking, positively locking and/or cohesive fashion.

A modular design has the advantage that the individual components—specifically the turbine and the cylinder head—can also be combined with other components, in particular other cylinder heads and turbines, according to the modular principle. The versatility of a component increases the quantities produced, as a result of which the production costs per unit can be reduced. Furthermore, this also reduces the costs involved if the turbine or the cylinder head must be exchanged, that is to say replaced, as a result of a defect.

Embodiments of the internal combustion engine are also advantageous in which the turbine housing is at least partially integrated in the cylinder head such that the cylinder head and at least a part of the turbine housing form a monolithic component.

The formation of a gas-tight, thermally highly loadable and therefore expensive connection between the cylinder head and turbine is eliminated out of principle as a result of the single-piece design. As a result, there is also no risk of exhaust gas unintentionally escaping into the atmosphere as a result of a leak. With regard to the coolant circuits or the connection of the coolant jackets and the leakage of coolant, a similar situation applies analogously.

The turbine that is used may be equipped with a variable turbine geometry, which permits a more precise adaptation to the respective operating point of an internal combustion engine by means of an adjustment of the turbine geometry or of the effective turbine cross section. Here, guide blades for influencing the flow direction are arranged in the inlet region of the turbine. In contrast to the rotor blades of the rotating rotor, the guide blades do not rotate with the shaft of the turbine.

If the turbine has a fixed, invariable geometry, the guide blades are arranged in the inlet region so as to be not only stationary but rather also completely immovable, that is to say rigidly fixed. In contrast, if use is made of a turbine with variable geometry, the guide blades are arranged so as to be stationary but not so as to be completely immovable, rather so as to be rotatable about their axes, such that the flow approaching the rotor blades can be influenced.

DETAILED DESCRIPTION

As required, detailed embodiments of the present disclosure are provided herein; however, it is to be understood that the disclosed embodiments are merely examples of the invention that may be embodied in various and alternative forms. The Figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
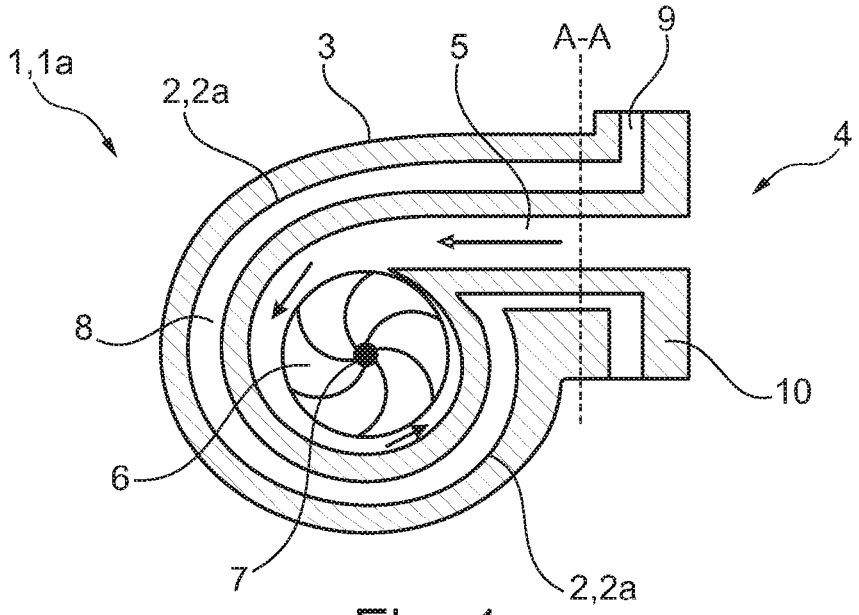
FIG. 1 shows the turbine of a first embodiment in a section perpendicular to the shaft of the turbine rotor on the basis of an exemplary embodiment.

FIG. 1 shows the turbine 1 of a first embodiment in a section perpendicular to the shaft 7 of the turbine rotor 6.

The turbine 1 is a radial turbine 1*a* which comprises a rotor 6 which is arranged in a turbine housing 3 and which is mounted on a rotatable shaft 7. In order that the rotor blades can be approached by flow radially, the flow duct 5 leading from the inlet region 4 is of spiral form, and the housing 3 for the supply of the exhaust gas is in the form of an encircling spiral housing.

To form a cooling arrangement, the housing 3 has an integrated coolant duct 8 which extends in spiral form around the shaft 7 in the housing 3 and which thus follows the flow duct 5 as far as the inlet for the exhaust gas into the rotor 6. It can be seen that the coolant duct 8 runs at a distance from the flow duct 5, specifically on that side of the flow duct 5 which faces away from the rotor 6. Adjacent to the inlet region 4 of the turbine housing 3 there are provided duct openings 9 for allowing coolant to be introduced into and discharged again from the coolant duct 8. For the fastening of the turbine 1 to the cylinder head, the housing 3 is equipped with a flange 10.

The walls 2 that delimit the coolant duct 8 are equipped, that is to say coated, with thermal insulation 2*a*. By the introduction of said insulation 2*a*, the introduction of heat from the housing 3 into the coolant is impeded, whereby it is achieved both that less heat is extracted from the housing 3 and also less heat is introduced into the coolant. The cooling power is targetedly reduced by the insulation 2*a* in that the thermal permeability of the heat-transmitting wall 2 is reduced.

Figure 2:
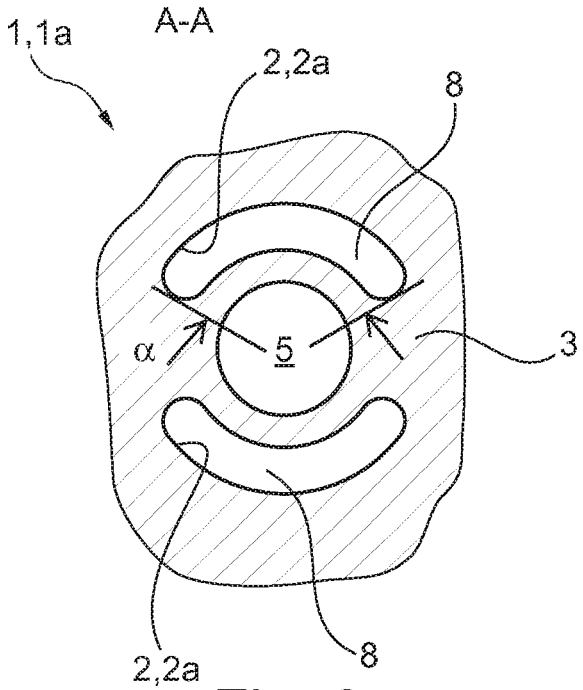
FIG. 2 shows the section A-A indicated in FIG. 1.

FIG. 2 shows the section A-A indicated in FIG. 1. It is sought merely to explain the additional features in relation to FIG. 1, for which reason reference is made otherwise to FIG. 1. The same reference symbols have been used for the same components.

In the embodiment illustrated in FIG. 2, the coolant duct 8 extends circumferentially around the flow duct 5 over an angle $\alpha \approx 90°$ measured from the central line of the flow duct 5. Consequently, in the present case, the coolant duct 8 does not lie—similarly to a coolant jacket—around the flow duct 5 over as large an area as possible. In this way, the amount of heat absorbed by the coolant is likewise limited, specifically by way of a reduction in size of the heat transfer surfaces.

Figure 3:
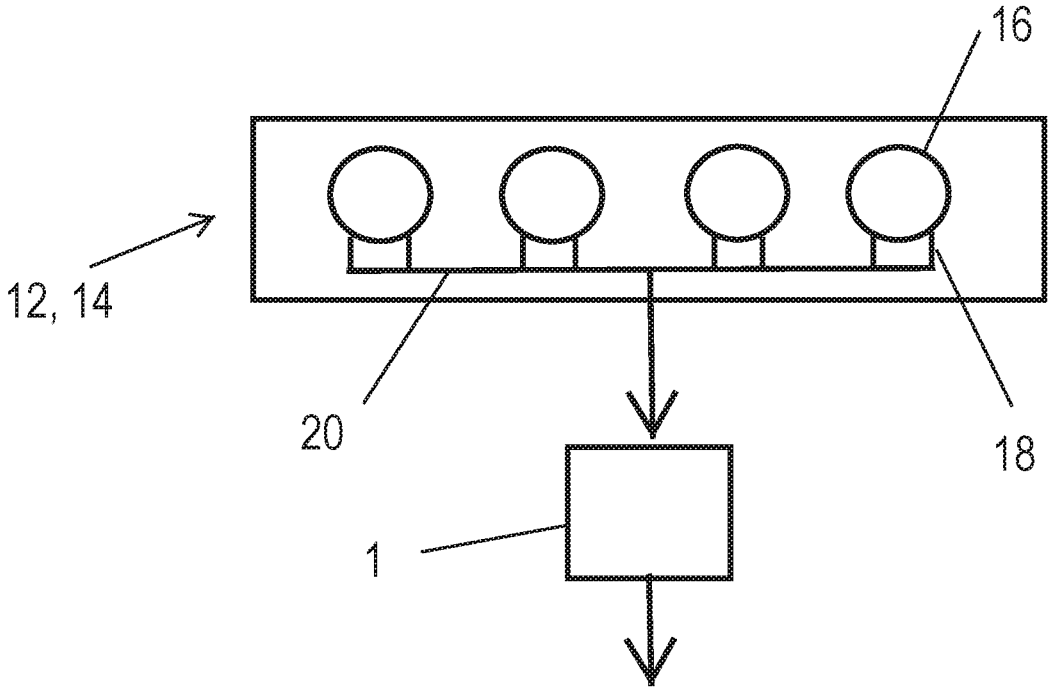
FIG. 3 shows a schematic of an internal combustion engine and the turbine of FIG. 1.

FIG. 3 illustrates a schematic of an internal combustion engine 12 and the turbine 1. The engine 12 has at least one cylinder head 14 with at least one cylinder 16, and each cylinder has at least one outlet 18 opening for discharging the exhaust gases from the cylinder and each outlet opening is adjoined by an exhaust line 20. The at least one exhaust line 20 of at least one cylinder issues into an inlet region, which transitions into an exhaust gas-conducting flow duct, of the turbine 1.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An internal combustion engine comprising:

at least one cylinder head having at least one cylinder, each cylinder having at least one outlet opening for discharging exhaust gases from the cylinder and each outlet opening being adjoined by an exhaust line; and a turbine having at least one rotor mounted on a rotatable shaft in a turbine housing, the turbine having, to form a cooling arrangement, at least one coolant duct integrated in the turbine housing being delimited and formed by at least one wall;

wherein the exhaust line of the at least one cylinder issues into an inlet region, which transitions into an exhaust gas-conducting flow duct, of the turbine;

wherein the exhaust gas-conducting flow duct is uninsulated such that introduction of heat into the turbine housing from exhaust gases in the exhaust gas-conducting flow duct is unrestricted; and wherein the at least one wall that delimits the at least one coolant duct is provided, at least in regions, with thermal insulation such that the thermal insulation contacts coolant in the at least one coolant passage such that the introduction of heat from the housing into coolant is impeded.

2. The internal combustion engine as claimed in claim 1, wherein more than 50% of the at least one wall is provided with thermal insulation.

3. The internal combustion engine as claimed in claim 1, wherein more than 70% of the at least one wall is provided with thermal insulation.

4. The internal combustion engine as claimed in claim 1, wherein more than 80% of the at least one wall is provided with thermal insulation.

5. The internal combustion engine as claimed in claim 1, wherein an entirety of the at least one wall is provided with thermal insulation.

6. The internal combustion engine as claimed in claim 1, wherein the thermal insulation comprises enamel.

7. The internal combustion engine as claimed in claim 1, wherein the thermal insulation comprises ceramic.

8. The internal combustion engine as claimed in claim 1, wherein the thermal insulation is formed as a coating by surface treatment.

9. The internal combustion engine as claimed in claim 1, wherein the turbine is a radial turbine.

10. The internal combustion engine as claimed in claim 9, wherein the at least one coolant duct, at least in sections, extends in a spiral form around the shaft in the housing.

11. The internal combustion engine as claimed in claim 9, wherein the at least one coolant duct extends circumferentially around and at a distance from the flow duct over an angle $\alpha$, where $\alpha \leq 45°$.

12. The internal combustion engine as claimed in claim 11, wherein $\alpha \leq 30°$.

13. The internal combustion engine as claimed in claim 1, wherein the turbine housing is a cast part into which the thermal insulation is introduced as a coating during post-processing.

14. The internal combustion engine as claimed in claim 1, wherein each cylinder has two outlet openings for discharging the exhaust gases out of the cylinder.

15. The internal combustion engine as claimed in claim 1, wherein the exhaust lines merge to form at least one overall exhaust line, thus forming at least one exhaust manifold, wherein said at least one overall exhaust line issues into the inlet region of the turbine.

16. The internal combustion engine as claimed in claim 1, wherein the exhaust lines of the cylinders merge to form at least one overall exhaust line within the cylinder head, thus forming at least one integrated exhaust manifold, wherein said at least one overall exhaust line issues into the inlet region of the turbine.

17. An engine comprising:

a cylinder head defining an outlet opening for discharging exhaust gases to an exhaust line; and a turbine having an inlet region and an uninsulated flow duct receiving exhaust gases from the exhaust line, the turbine having at least one rotor mounted on a rotatable shaft in a turbine housing, the turbine housing defining a cooling duct having a wall to contact coolant, the wall provided with thermal insulation.

18. An engine turbine comprising:

a housing forming an inlet region and an uninsulated flow duct configured to receive engine exhaust gases and introduce heat into the housing; and a rotor mounted on a rotatable shaft within the flow duct;

wherein the housing defines a cooling duct therein, a thermal insulation provided on the cooling duct to contact coolant and to limit cooling of the turbine, the insulation having a lower thermal conductivity than the housing.

19. The engine turbine of claim 18 wherein the cooling duct extends in a spiral form around the shaft.

20. The engine of claim 17 wherein the cooling duct extends in a spiral form around the shaft.

* * * * *